US011127332B2

(12) United States Patent
Bae et al.

(10) Patent No.: US 11,127,332 B2
(45) Date of Patent: Sep. 21, 2021

(54) ELECTRONIC DEVICE FOR CONTROLLING SOURCE DRIVING OF PIXEL ON BASIS OF CHARACTERISTICS OF IMAGE, AND IMAGE OUTPUT METHOD USING ELECTRONIC DEVICE

(71) Applicant: Samsung Electronics Co., Ltd., Suwon-si (KR)

(72) Inventors: Jongkon Bae, Suwon-si (KR); Yohan Lee, Suwon-si (KR); Donghwy Kim, Suwon-si (KR); Yunpyo Hong, Suwon-si (KR); Seungkyu Choi, Suwon-si (KR); Dongkyoon Han, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 15/733,247

(22) PCT Filed: Dec. 20, 2018

(86) PCT No.: PCT/KR2018/016308

§ 371 (c)(1),
(2) Date: Jun. 16, 2020

(87) PCT Pub. No.: WO2019/125001

PCT Pub. Date: Jun. 27, 2019

(65) Prior Publication Data

US 2020/0388205 A1 Dec. 10, 2020

(30) Foreign Application Priority Data

Dec. 20, 2017 (KR) ..... 10-2017-0176564

(51) Int. Cl.
*G09G 3/20* (2006.01)

(52) U.S. Cl.
CPC ..... *G09G 3/2003* (2013.01); *G09G 2310/027* (2013.01); *G09G 2310/0291* (2013.01); *G09G 2330/021* (2013.01)

(58) Field of Classification Search
CPC ..... G09G 3/2003; G09G 2310/027; G09G 2310/0291; G09G 2330/021; G09G 3/20
See application file for complete search history.

(56) References Cited

U.S. PATENT DOCUMENTS 9,773,468 B2 9/2017 Woo et al.
10,078,980 B2 * 9/2018 Kong ..... G09G 3/2003
(Continued)

FOREIGN PATENT DOCUMENTS

KR 10-2014-0109152 A 9/2014
KR 10-2017-0024717 A 3/2017
(Continued)

OTHER PUBLICATIONS

International Search Report and Written Opinion of the International Searching Authority in connection with International Application No. PCT/KR2018/016308 dated Apr. 5, 2019, 10 pages.

*Primary Examiner* — Grant Sitta

(57) ABSTRACT

An electronic device according to various embodiments of the disclosure includes a processor, a display panel that includes a plurality of pixels (the plurality of pixels include a first pixel and a second pixel), and a display driving circuit that drives the display panel and receives image data to be displayed through the display panel from the processor, and the display driving circuit is composed to identify output data of the first pixel and output data of the second pixel to display the image data, and, when the output data of the first pixel and the output data of the second pixel have more than
(Continued)

a specified similarity, is composed to drive the first pixel and the second pixel by using a source amplifier specified in relation to the first pixel.

13 Claims, 12 Drawing Sheets

(56) References Cited

U.S. PATENT DOCUMENTS

| | | | | |
|---|---|---|---|---|
| 10,192,476 | B2 | 1/2019 | Bae et al. | |
| 10,199,005 | B2 | 2/2019 | Kong et al. | |
| 10,275,012 | B2 | 4/2019 | Bae et al. | |
| 10,614,748 | B2 | 4/2020 | Bae et al. | |
| 2006/0097791 | A1* | 5/2006 | Shuler, Jr. | H03F 1/14 330/292 |
| 2008/0284768 | A1* | 11/2008 | Yoshida | G09G 3/2025 345/208 |
| 2010/0220092 | A1* | 9/2010 | Kimura | G09G 3/22 345/213 |
| 2011/0157247 | A1* | 6/2011 | Tanaka | G09G 3/3426 345/690 |
| 2012/0075536 | A1* | 3/2012 | Uehara | G09G 3/2081 348/731 |
| 2014/0253532 | A1* | 9/2014 | Woo | G09G 3/20 345/212 |
| 2016/0162242 | A1* | 6/2016 | Xiong | G06F 3/1431 345/5 |
| 2017/0047015 | A1* | 2/2017 | Takahara | H01L 27/3211 |
| 2017/0047044 | A1* | 2/2017 | Zheng | G09G 3/32 |
| 2017/0287429 | A1 | 10/2017 | Kong et al. | |
| 2017/0309219 | A1 | 10/2017 | Kong et al. | |
| 2017/0336851 | A1 | 11/2017 | Bae et al. | |

FOREIGN PATENT DOCUMENTS

| | | | |
|---|---|---|---|
| KR | 10-2017-0111788 | A | 10/2017 |
| KR | 10-2017-0121676 | A | 11/2017 |
| KR | 10-2017-0131072 | A | 11/2017 |

* cited by examiner

ELECTRONIC DEVICE FOR CONTROLLING SOURCE DRIVING OF PIXEL ON BASIS OF CHARACTERISTICS OF IMAGE, AND IMAGE OUTPUT METHOD USING ELECTRONIC DEVICE

CROSS-REFERENCE TO RELATED APPLICATIONS

This application is a 371 National Stage of International Application No. PCT/KR2018/016308, filed Dec. 20, 2018, which claims priority to Korean Patent Application No. 10-2017-0176564, filed Dec. 20, 2017, the disclosures of which are herein incorporated by reference in their entirety.

BACKGROUND

1. Field

Various embodiments of the disclosure relate to an electronic device including a display and an image output method.

2. Description of Related Art

An electronic device such as smart phones and tablet PCs may output various contents through a display. The electronic device may execute an application and may display an execution screen of the application on the display. For example, the electronic device may execute a browser application to provide various search screens.

The electronic device may operate by power provided from a charged battery. A power consumption of the display may occupy a large portion of total power consumption of the electronic device.

SUMMARY

The electronic device according to the related art supplies a signal through a source amplifier for each pixel by a display driver integrated circuit (DDI) that drives a display panel. Since the electronic device supplies power signals to pixels having the same or similar image data as pixels adjacent to one another, there is a problem in that the power consumed by the display panel increases.

An electronic device according to various embodiments of the disclosure includes a processor, a display panel that includes a plurality of pixels (the plurality of pixels include a first pixel and a second pixel), and a display driving circuit that drives the display panel and receives image data to be displayed through the display panel from the processor, and the display driving circuit may be composed to identify output data of the first pixel and output data of the second pixel to display the image data, and, when the output data of the first pixel and the output data of the second pixel have more than a specified similarity, may be composed to drive the first pixel and the second pixel by using a source amplifier specified in relation to the first pixel.

An electronic device and an image output method according to various embodiments of the disclosure may reduce a power consumption in a display panel by limiting an output of some amplifiers when output values of adjacent pixels are the same or similar.

An electronic device and an image output method according to various embodiments of the disclosure may be used to share a source amplifier between adjacent pixels by detecting a moving level of an image in an output display.

An electronic device and an image output method according to various embodiments of the disclosure may reduce a level difference on a screen that may be viewed by the user depending on sharing of a source amplifier between adjacent pixels.

DETAILED DESCRIPTION

Figure 1:
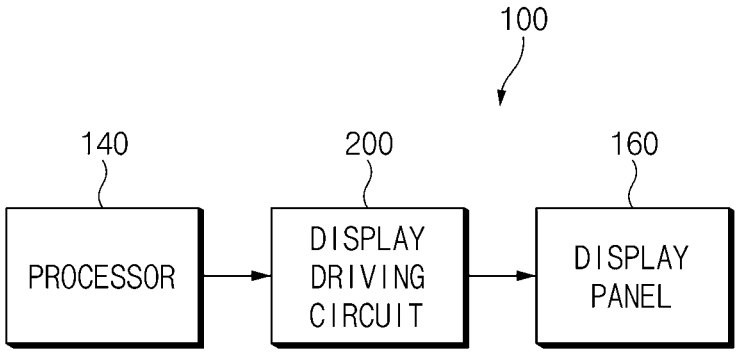
FIG. 1 is a diagram schematically illustrating a configuration of an electronic device including a display driving circuit according to various embodiments.

Hereinafter, various embodiments of the disclosure may be described with reference to accompanying drawings. Accordingly, those of ordinary skill in the art will recognize that modifications, equivalents, and/or alternatives on the various embodiments described herein can be variously made without departing from the scope and spirit of the disclosure. With regard to description of drawings, similar components may be marked by similar reference numerals.

In the disclosure, the expressions "have", "may have", "include" and "comprise", or "may include" and "may comprise" used herein indicate existence of corresponding features (e.g., components such as numeric values, functions, operations, or parts) but do not exclude presence of additional features.

In the disclosure, the expressions "A or B", "at least one of A or/and B", or "one or more of A or/and B", and the like may include any and all combinations of one or more of the associated listed items. For example, the term "A or B", "at least one of A and B", or "at least one of A or B" may refer to all of the case (1) where at least one A is included, the case (2) where at least one B is included, or the case (3) where both of at least one A and at least one B are included.

The terms, such as "first", "second", and the like used in the disclosure may be used to refer to various components regardless of the order and/or the priority and to distinguish the relevant components from other components, but do not limit the components. For example, "a first user device" and "a second user device" indicate different user devices regardless of the order or priority. For example, without departing the scope of the disclosure, a first component may be referred to as a second component, and similarly, a second component may be referred to as a first component.

It will be understood that when a component (e.g., a first component) is referred to as being "(operatively or communicatively) coupled with/to" or "connected to" another component (e.g., a second component), it may be directly coupled with/to or connected to the other component or an intervening component (e.g., a third component) may be present. In contrast, when a component (e.g., a first component) is referred to as being "directly coupled with/to" or "directly connected to" another component (e.g., a second component), it should be understood that there are no intervening component (e.g., a third component).

According to the situation, the expression "configured to" used in the disclosure may be used as, for example, the expression "suitable for", "having the capacity to", "designed to", "adapted to", "made to", or "capable of". The term "configured to" must not mean only "specifically designed to" in hardware. Instead, the expression "a device configured to" may mean that the device is "capable of" operating together with another device or other parts. For example, a "processor configured to (or set to) perform A, B, and C" may mean a dedicated processor (e.g., an embedded processor) for performing a corresponding operation or a generic-purpose processor (e.g., a central processing unit (CPU) or an application processor) which performs corresponding operations by executing one or more software programs which are stored in a memory device.

Terms used in the disclosure are used to describe specified embodiments and are not intended to limit the scope of the disclosure. The terms of a singular form may include plural forms unless otherwise specified. All the terms used herein, which include technical or scientific terms, may have the same meaning that is generally understood by a person skilled in the art. It will be further understood that terms, which are defined in a dictionary and commonly used, should also be interpreted as is customary in the relevant related art and not in an idealized or overly formal unless expressly so defined in various embodiments of the disclosure. In some cases, even if terms are terms which are defined in the disclosure, they may not be interpreted to exclude embodiments of the disclosure.

An electronic device according to various embodiments of the disclosure may include at least one of, for example, smartphones, tablet personal computers (PCs), mobile phones, video telephones, electronic book readers, desktop PCs, laptop PCs, netbook computers, workstations, servers, personal digital assistants (PDAs), portable multimedia players (PMPs), Motion Picture Experts Group (MPEG-1 or MPEG-2) Audio Layer 3 (MP3) players, mobile medical devices, cameras, or wearable devices. According to various embodiments, the wearable device may include at least one of an accessory type (e.g., watches, rings, bracelets, anklets, necklaces, glasses, contact lens, or head-mounted-devices (HMDs)), a fabric or garment-integrated type (e.g., an electronic apparel), a body-attached type (e.g., a skin pad or tattoos), or a bio-implantable type (e.g., an implantable circuit).

Hereinafter, electronic devices according to various embodiments will be described with reference to the accompanying drawings. In the disclosure, the term "user" may refer to a person who uses an electronic device or may refer to a device (e.g., an artificial intelligence electronic device) that uses the electronic device.

FIG. 1 is a diagram schematically illustrating a configuration of an electronic device including a display driving circuit according to various embodiments.

Referring to FIG. 1, an electronic device 100 may include a processor (e.g., an application processor (AP)) 140, a display driver IC (DDI) 200, and a display panel 160. The electronic device 100 may be implemented as, for example, a portable electronic device. According to various embodiments, the display driving circuit 200 and the display panel 160 may be implemented as separate (or external) display devices (or display modules) excluding the processor 140.

The processor 140 may control an overall operation of the electronic device 100. According to one embodiment, the processor 140 may be implemented as an integrated circuit, a system on a chip, or a mobile AP. The processor 140 may transmit data (e.g., image data, video data, or still image data) to be displayed to the display driving circuit 200. According to an embodiment, the data may be divided in units of line data corresponding to a horizontal line (or vertical line) of the display panel 160.

The display driving circuit 200 may change the image data transmitted from the processor 140 into a form that can be transmitted to the display panel 160, and may transmit the changed image data to the display panel 160. The changed image data (hereinafter, output data) may be supplied in units of pixels. In this case, a pixel is a structure in which sub-pixels Red, Green, and Blue are adjacently arranged in associated with a specified color display, and one pixel may include an RGB sub-pixel (RGB stripe layout structure) or RGGB sub-pixels (pentile layout structure). In this case, the layout structure of the RGGB sub-pixels may be replaced with the layout structure of the RGBG sub-pixels. Alternatively, the pixel may be replaced with an RGBW sub-pixel layout structure.

According to one embodiment, the display driving circuit 200, when the output data between adjacent pixels has a difference within a specified range, may drive the first pixel and the second pixel together, by using the source amplifier of the first pixel, and may deactivate the source amplifier of the second pixel. Additional information regarding the sharing of the source amplifier among adjacent pixels may be provided through FIGS. 2 to 9.

The display panel 160 may display the output data by the display driving circuit 200. According to embodiments, the display panel 160 may be implemented as a thin film transistor-liquid crystal display (TFT-LCD) panel, a light emitting diode (LED) display panel, an organic LED (OLED) display panel, an active matrix OLED (AMOLED) display panel, a flexible display panel, or the like.

The display panel 160, for example, may have a structure in which gate lines and source lines are intersected in a matrix form.

A gate signal may be supplied to the gate lines. According to an embodiment, a first gate signal may be supplied to odd gate lines among the gate lines, and a second gate signal may be supplied to even gate lines. The first gate signal and the second gate signal may include a signal alternately supplied to each other. Alternatively, after the first gate signal is sequentially supplied from a start line to an end line of the odd gate lines, the second gate signal may be sequentially supplied from the start line to the end line of the even gate lines.

A signal corresponding to the output data may be supplied to the source lines. The signal corresponding to the output data may be supplied to a source driver under the control of a timing controller inside the display driving circuit 140.

Figure 2:
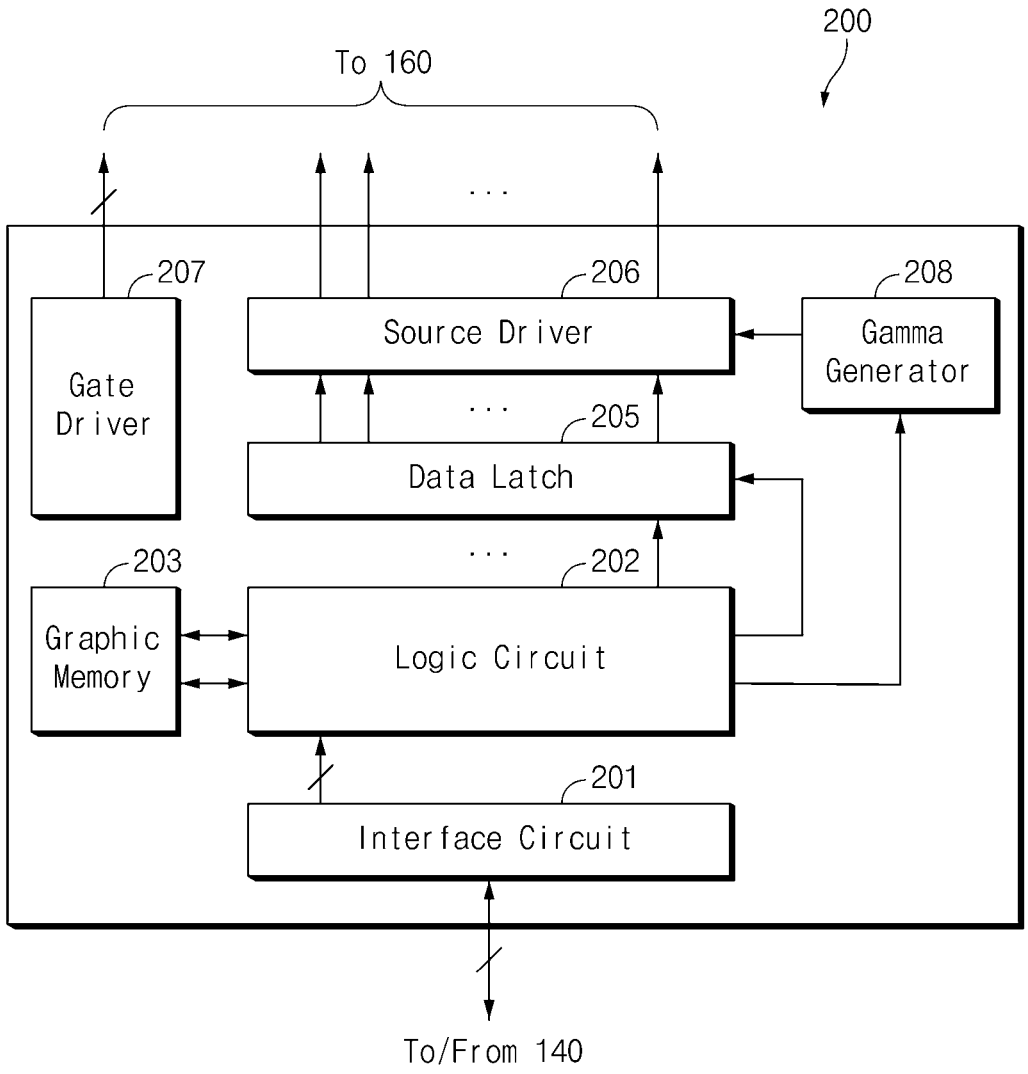
FIG. 2 is a diagram illustrating a display driving circuit according to various embodiments.

FIG. 2 is a diagram illustrating a display driving circuit according to various embodiments.

Referring to FIGS. 1 and 2, the display driving circuit 200 is an interface circuit 201, a logic circuit 202, a graphic memory 203, a data latch (or shift register) 205, a source driver 206, a gate driver 207, and a gamma generator 208.

The interface circuit 201 may interface signals or data exchanged between the processor 140 and the display driving circuit 200. The interface circuit 201 may interface line data transmitted from the processor 140, and may transmit the interfaced line data to a graphic memory write controller of the logic circuit 202.

According to one embodiment, the interface circuit 201 may be an interface related to a serial interface, such as a Mobile Industry Processor Interface (MIPI®), a Mobile Display Digital Interface (MDDI), a DisplayPort, an Embedded DisplayPort (eDP), or the like.

According to various embodiments, the logic circuit 202 may include the graphic memory write controller, the timing controller, a graphic memory read controller, an image processing unit, a source shift register controller, a data shift register, and a source sharing control unit.

The graphic memory write controller of the logic circuit 202 may receive the line data transmitted from the interface circuit 201 and may control an operation of writing the received line data in the graphic memory 203.

The timing controller may supply a synchronizing signal and/or a clock signal to each component (e.g., a data comparison circuit or the graphic memory read controller) of the display driving circuit 200. In addition, the timing controller may transmit a read command (RCMD) for controlling a read operation of the graphic memory 203 to the graphic memory read controller.

According to various embodiments, the timing controller may control output data supply of the source driver 206. In addition, the timing controller may control a gate signal output of the gate driver 207. For example, the timing controller may control the gate driver 207 to output a gate signal by dividing odd and even lines among gate signal lines of the display panel 160.

According to one embodiment, the timing controller may control the source driver 206 to share and use outputs of some amplifiers among a plurality of amplifiers allocated to pixels in response to a control of the processor 140.

The graphic memory read controller may perform a read operation on the line data stored in the graphic memory 203. According to an embodiment, the graphic memory read controller may perform the read operation on all or part of the line data stored in the graphic memory 203 based on the read command RCMD for the line data. The graphic memory read controller may transmit all or part of the line data read from the graphic memory 203 to the image processing unit. The graphic memory write controller and the graphic memory read controller are described separately for convenience of description, but may be implemented as one graphic memory controller.

The image processing unit may improve image quality by processing all or part of the line data transmitted from the graphic memory read controller. The output data with improved image quality may be transferred to the timing controller, and the timing controller may transmit the output data to the source driver 206 through the data latch 205.

The source shift register controller may control a data shifting operation of the data shift register. According to an embodiment, the source shift register controller may perform a control such as writing the line data of the graphic memory 203 and image preprocessing of the image processing unit in response to instructions provided from the processor 140.

The data shift register may shift output data transmitted through the source shift register controller under control of the source shift register controller. The data shift register may sequentially transmit the shifted output data to the data latch 205.

The source sharing control unit may detect a scene transition level of image data received from the processor 140. The scene transition level may be calculated based at least on a difference value of output data between a previous frame and a current frame (or a difference value of output data between a current frame and a subsequent frame) to be output using at least a part of the display panel. For example, in the case of a video playback screen, the scene transition level may be relatively large. For another example, in the case of a web search screen that does not include a video, the scene transition level may be relatively small.

The source sharing control unit may determine a threshold value required for control of the source amplifier, and may control a switch connected to the source amplifier, based on the determined threshold value. The source sharing control unit may limit outputs of some source amplifiers under a specified condition, thereby reducing power consumed by the display panel 160. Additional information regarding the sharing of the source amplifier between adjacent pixels may be provided through FIGS. 3A to 9.

The graphic memory 203 may store the line data input through the graphic memory write controller under the control of the graphic memory write controller. The graphic memory 203 may operate as a buffer memory in the display driving circuit 200. According to an embodiment, the graphic memory 203 may include a graphic random access memory (GRAM).

The data latch 205 may store output data sequentially transmitted from a data shift register. The data latch 204 may transmit the stored output data to the source driver 206 in units of horizontal lines of the display panel 160.

The source driver 206 may transmit the line data received from the data latch 205 to the display panel 160. According to an embodiment, the source driver 206 may include a source amplifier connected to each sub-pixel (or per channel allocated to each sub-pixel).

The source driver 206 may share and use the output of the source amplifier between adjacent pixels. The source driver 206 may include switches to activate the source amplifiers and to share the output of the source amplifier. The switches included in the source driver 206 may be turned on or off in response to a control signal provided from the logic circuit 202 (e.g., a timing controller). Accordingly, the source driver 206 may reduce power consumption by activating only some of a plurality of amplifiers allocated to adjacent pixels.

The gate driver 207 may drive the gate lines of the display panel 160. That is, as an operation of the pixels implemented on the display panel 160 is controlled by the source driver 206 and the gate driver 207, output data (or an image corresponding to the output data) input from the processor 140 may be displayed on the display panel 160. The gate driver 207 may divide the gate lines of the display panel 160 into the odd lines or the even lines under the control of the logic circuit 202, and may supply the gate signal to the divided lines.

The gamma generator 208 may generate and supply a gamma value (or a gamma voltage corresponding to the gamma value) related to brightness adjustment of the display panel 160. The gamma generator 208 may generate an analog gamma value corresponding to at least one of a first color (e.g., Red), a second color (e.g., Green), and a third color (e.g., Blue), and may supply the generated analog gamma value to the source driver 206. The analog gamma value may be generated based on a gamma curve stored in correspondence with a designated color.

Figure 3A:
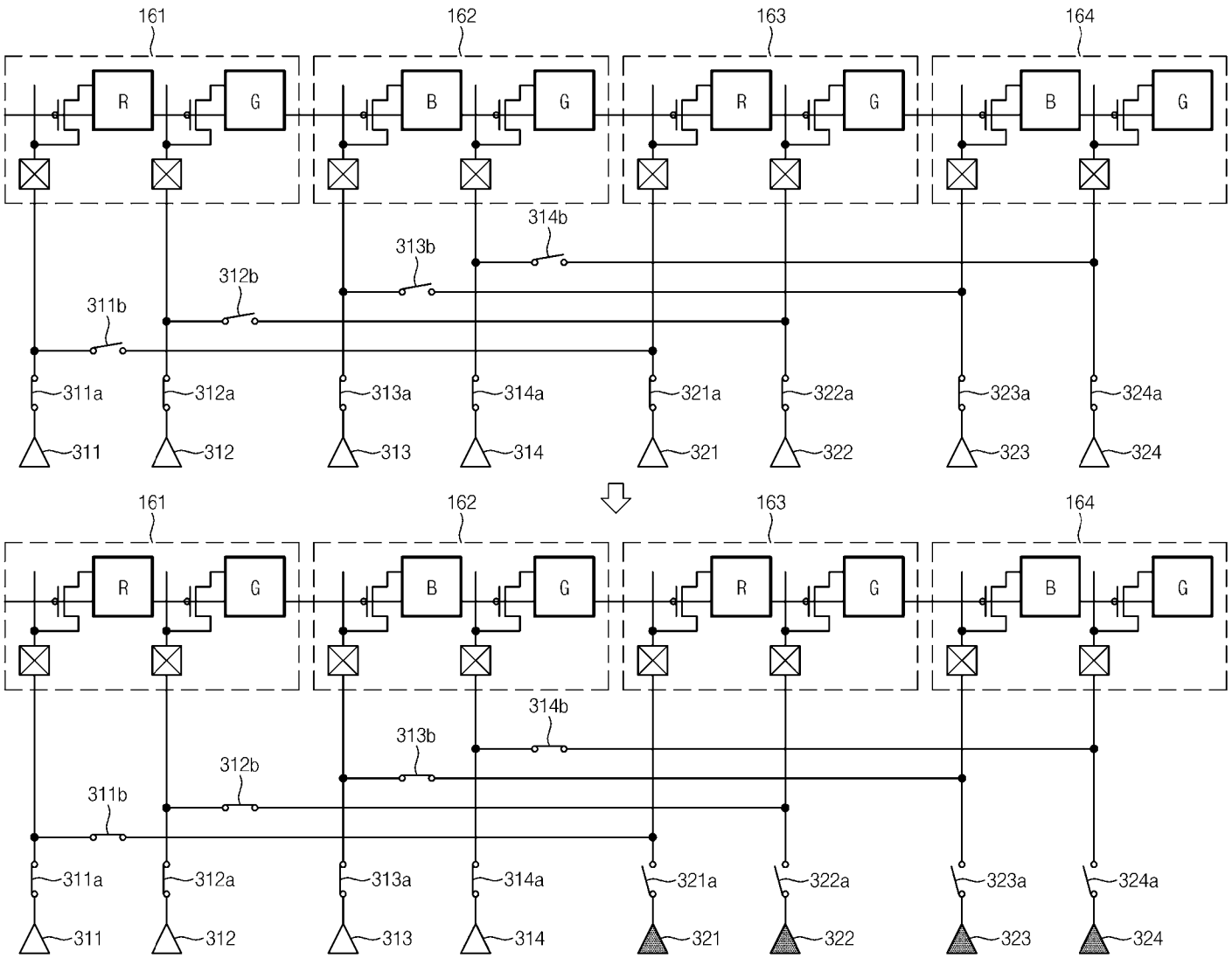
FIG. 3A is a diagram illustrating an example of some components of an electronic device including a pentile display panel according to various embodiments.

FIG. 3A is a diagram illustrating an example of some components of an electronic device including a pentile display panel according to various embodiments. FIG. 3A is exemplary and is not limited thereto.

Referring to FIGS. 2 and 3A, some components of the electronic device 100 may include the display panel 160 that is a pentile type and the source driver 206.

The display panel 160 of the pentile type may be, for example, in a form in which the gate lines and pentile source lines are alternately arranged. In FIG. 3A, although the display panel 160 is illustrated mainly including a case in which a first pixel 161, a second pixel 162, a third pixel 163, and a fourth pixel 164 are disposed adjacent to one another, the disclosure is not limited thereto (refer to FIG. 3B).

Pads connected to the output terminals of the amplifiers of the source driver 206 may be disposed on one side of the display panel 160, for example, at one end of each channel of the pentile source lines.

In the first pixel 161, the source driver 206 may include, for example, a first amplifier 311 supplying a signal to a first channel and a second amplifier 312 supplying a signal to a second channel among the pentile source lines. In addition, the source driver 206 may include a first switch 311*a* that is connected to an output terminal of the first amplifier 311 and a second switch 312*a* that is connected to an output terminal of the second amplifier 312.

In the second pixel 162, the source driver 206 may include a third amplifier 313 supplying a signal to a third channel and a fourth amplifier 314 supplying a signal to a fourth channel. In addition, the source driver 206 may include a third switch 313*a* that is connected to an output terminal of the third amplifier 313 and a fourth switch 314*a* that is connected to an output terminal of the fourth amplifier 314.

In the third pixel 163, the source driver 206 may include, for example, a first amplifier 321 supplying the signal to the first channel and a second amplifier 322 supplying the signal to the second channel among the pentile source lines. In addition, the source driver 206 may include a first switch 321*a* that is connected to an output terminal of the first amplifier 321 and a second switch 322*a* that is connected to an output terminal of the second amplifier 322.

In the fourth pixel 164, the source driver 206 may include a third amplifier 323 supplying the signal to the third channel and a fourth amplifier 324 supplying the signal to the fourth channel. In addition, the source driver 206 may include a third switch 323*a* that is connected to an output terminal of the third amplifier 323 and a fourth switch 324*a* that is connected to an output terminal of the fourth amplifier 324.

According to various embodiments, the source driver 206 may include first to fourth sharing switches 311*b*, 312*b*, 313*b*, and 314*b*. The first sharing switch 311*b* may be disposed between the output terminal of the first amplifier 311 of the first pixel 161 and the output terminal of the first amplifier 321 of the third pixel 163. The second sharing switch 312*b* may be disposed between the output terminal of the second amplifier 312 of the first pixel 161 and the output terminal of the second amplifier 322 of the third pixel 163. The third sharing switch 313*b* may be disposed between the output terminal of the third amplifier 313 of the second pixel 162 and the output terminal of the third amplifier 323 of the fourth pixel 164. The fourth sharing switch 314*b* may be disposed between the output terminal of the fourth amplifier 314 of the second pixel 162 and the output terminal of the fourth amplifier 324 of the fourth pixel 164.

According to various embodiments, the display driving circuit 200, when the output data of adjacent pixels are the same or within a specified threshold value (hereinafter, a shared threshold value), may drive other pixels together using the first to fourth sharing switches 311*b*, 312*b*, 313*b*, and 314*b*, by using source amplifiers corresponding to one pixel. For example, in FIG. 3A, the display driving circuit 200 may supply the output of the source amplifier supplied to the first pixel 161 and the second pixel 162 to the third pixel 163 and the fourth pixel 164 by using the first to fourth sharing switches 311*b*, 312*b*, 313*b*, and 314*b*.

For example, the display driving circuit 200 may calculate a difference value between output data of the first pixel 161 and output data of the third pixel 163. When the difference value is within a shared threshold value (e.g., 0 to 2 grayscale), the display driving circuit 200 may turn on the first and second source amplifiers 311 and 312 corresponding to the first pixel 161, and may turn off the first and second source amplifiers 321 and 322 corresponding to the third pixel 163. When the difference value exceeds the shared threshold value (e.g., 0 to 2 grayscale), the display driving circuit 200 may turn on both the first and second source amplifiers 311 and 312 corresponding to the first pixel 161 and the first and second source amplifiers 321 and 322 corresponding to the third pixel 163.

For another example, the display driving circuit 200 may calculate a difference value between output data of the second pixel 162 and output data of the fourth pixel 164. When the difference value is within the shared threshold value (e.g., 0 to 2 grayscale), the display driving circuit 200 may turn on the third and fourth source amplifiers 313 and 314 corresponding to the second pixel 162, and may turn off the third and fourth source amplifiers 323 and 324 corresponding to the fourth pixel 164. When the difference value exceeds the shared threshold value (e.g., 0 to 2 grayscale), the display driving circuit 200 may turn on both the third and fourth source amplifiers 313 and 314 corresponding to the second pixel 162 and the third and fourth source amplifiers 323 and 324 corresponding to the fourth pixel 164.

According to various embodiments, the display driving circuit 200 may adjust the shared threshold value, based on the scene transition level of the displayed image. For example, in the case of video playback having a lot of screen transitions, the shared threshold value may be increased (e.g., 2 to 7 grayscale). For another example, in the case of a web page having relatively few screen transitions, the shared threshold value may be decreased (e.g., 0 to 2 grayscale). Additional information regarding a method of controlling the source amplifier, based on the scene transition level may be provided through FIGS. 4A to 9.

According to various embodiments, the display driving circuit 200 may keep the first to fourth source amplifiers 311 to 314 that supply output data to the first pixel 161 and the second pixel 162 always turned on. In contrast, the display driving circuit 200 may turn on or off the first to fourth source amplifiers 321 to 324 that supply output data to the third pixel 163 and the fourth pixel 164, based on an image pattern (scene transition level). Through this, in a screen where there are many pixels having the same or similar output data value as the surrounding pixels (e.g., an Internet search screen, an SNS screen), the power consumed by the display panel 160 may be reduced by up to 50%.

The above-described control of the amplifier and the above-described control of the switches may be performed by, for example, instructions received from the processor 140 and written to the source shift register controller. An instruction written in the source shift register controller is transferred to a timing controller, and the timing controller may perform a data transfer depending on execution of the instruction.

Figure 3B:
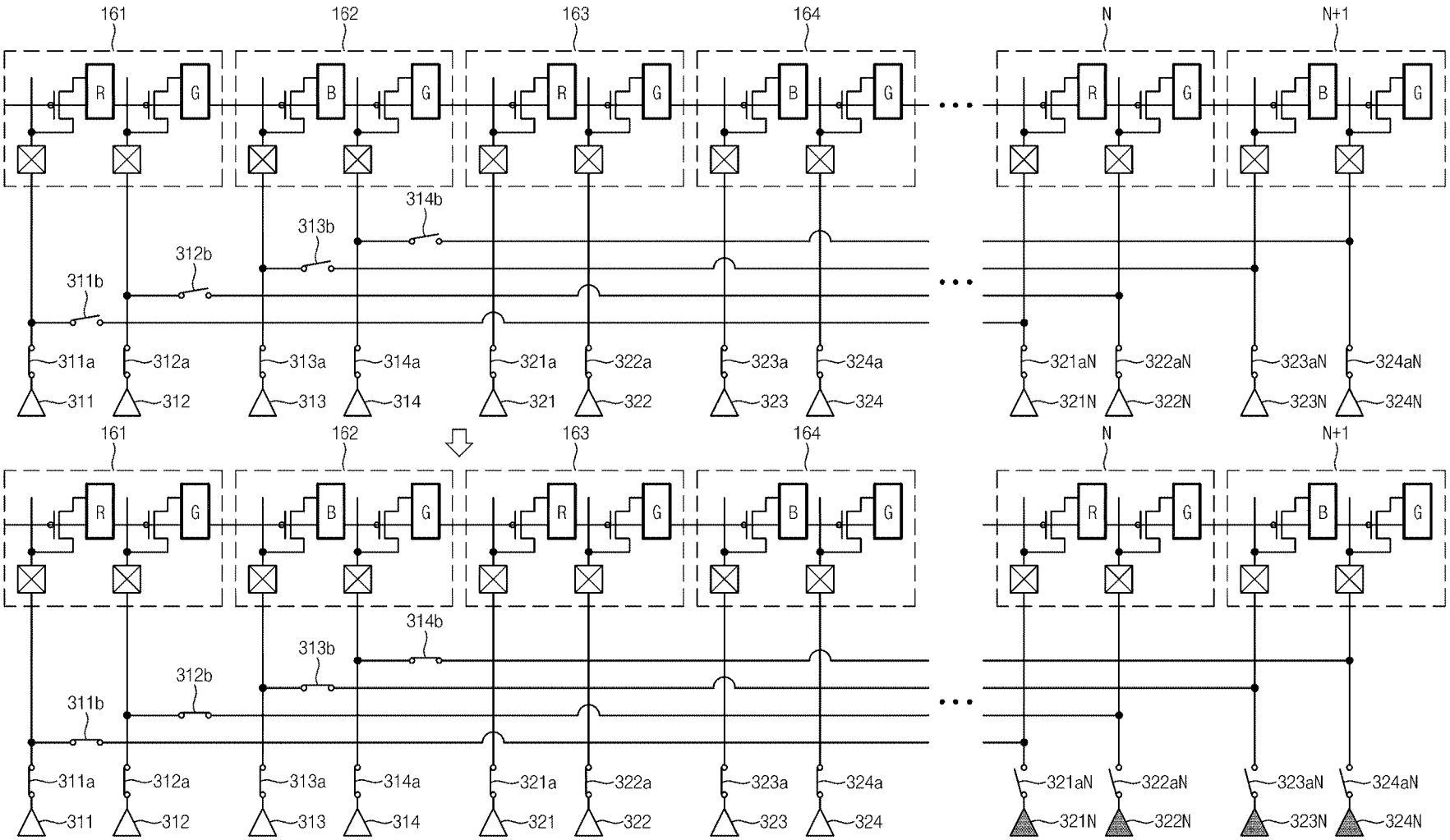
FIG. 3B illustrates sharing of a source amplifier among pixels within a specified distance according to various embodiments.

FIG. 3B illustrates sharing of a source amplifier among pixels within a specified distance according to various embodiments.

Referring to FIG. 3B, the display driving circuit 200 may share a source amplifier among the pixels spaced apart by a specified distance.

For example, the display driving circuit 200 may share the output of the source amplifier of the first pixel 161 and the second pixel 162 with N-th pixels (e.g., N=5, 7, . . . ) and N+1-th pixels, which are separated by a specified distance, not the adjacent third pixel 163 and the fourth pixel 164.

The source driver 206 may include first to fourth sharing switches 311*c*, 312*c*, 313*c*, and 314*c*. The first sharing switch 311*c* may be disposed between the output terminal of the first amplifier 311 of the first pixel 161 and an output terminal of a first amplifier 321N of the N-th pixel. The second sharing switch 312*c* may be disposed between the output terminal of the second amplifier 312 of the first pixel 161 and an output terminal of a second amplifier 322N of the N-th pixel. The third sharing switch 313*c* may be disposed between the output terminal of the third amplifier 313 of the second pixel 162 and an output terminal of a third amplifier 323N of the N+1-th pixel. The fourth sharing switch 314*c* may be disposed between the output terminal of the fourth amplifier 314 of the fourth pixel 162 and an output terminal of a fourth amplifier 324N of the N+1-th pixel.

According to various embodiments, when output data of adjacent pixels are the same or are within a specified threshold value (hereinafter, shared threshold value), the display driving circuit 200 may drive other pixels together, using the first to fourth sharing switches 311*c*, 312*c*, 313*c*, and 314*c*, by using source amplifiers corresponding to one pixel. For example, in FIG. 3B, the display driving circuit 200 may supply an output of the source amplifier supplied to the first pixel 161 and the second pixel 162 to the third pixel 163 and the fourth pixel 164 by using the first to fourth sharing switches 311*b*, 312*b*, 313*b*, and 314*b*.

For example, the display driving circuit 200 may calculate a difference value between the output data of the first pixel 161 and output data of the N-th pixel. When the difference value is within the shared threshold value (e.g., 0 to 2 grayscale), the display driving circuit 200 may turn on the first and second source amplifiers 311 and 312 corresponding to the first pixel 161, and may turn off the first and second source amplifiers 321N and 322N corresponding to the N-th pixel. When the difference value exceeds the shared threshold value (e.g., 0 to 2 grayscale), the display driving circuit 200 may turn on both the first and second source amplifiers 311 and 312 corresponding to the first pixel 161 and the first and second source amplifiers 321N and 322N corresponding to the N-th pixel.

For another example, the display driving circuit 200 may calculate a difference value between the output data of the second pixel 162 and output data of the N+1-th pixel. When the difference value is within the shared threshold value (e.g., 0 to 2 grayscale), the display driving circuit 200 may turn on the third and fourth source amplifiers 313 and 314 corresponding to the second pixel 162, and may turn off the third and fourth source amplifiers 323N and 324N corresponding to the N+1-th pixel. When the difference value exceeds the shared threshold value (e.g., 0 to 2 grayscale), the display driving circuit 200 may turn on both the third and fourth source amplifiers 313 and 314 corresponding to the second pixel 162 and the third and fourth source amplifiers 323N and 324N corresponding to the N+1-th pixel.

Figure 4A:
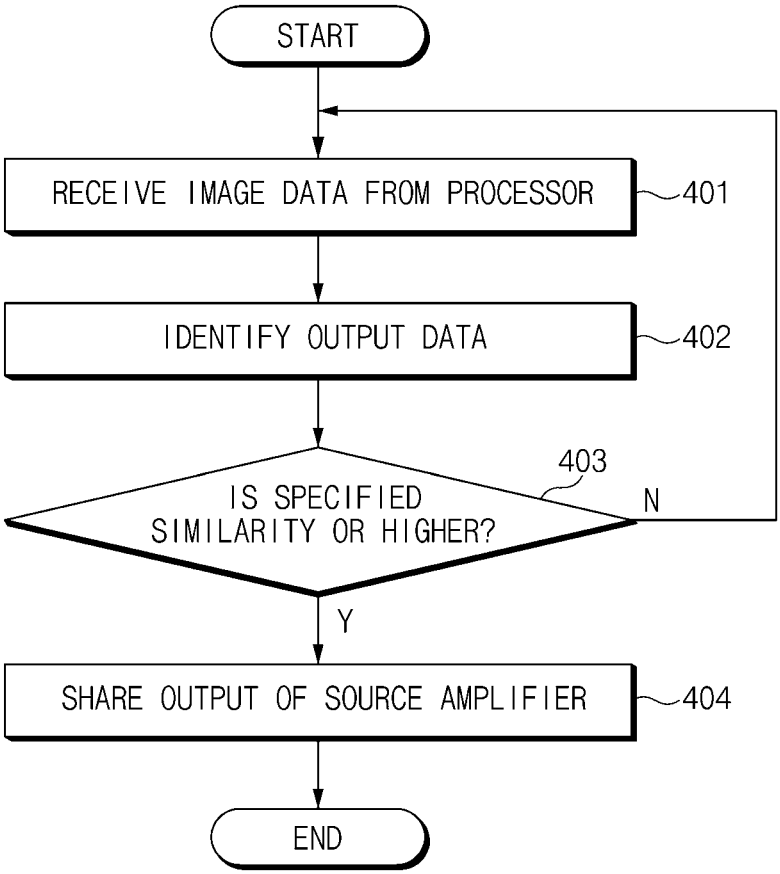
FIG. 4A is a flowchart illustrating an image output method according to various embodiments.

FIG. 4A is a flowchart illustrating an image output method according to various embodiments.

Referring to FIG. 4A, in operation 401, the display driving circuit 200 may receive image data associated with a plurality of pixels from the processor 140.

In operation 402, the display driving circuit 200 may identify the output data of the first pixel and the output data of the second pixel included in a plurality of pixels to which the output of the source amplifier may be shared.

In operation 403, the display driving circuit 200 may determine whether the output data of the first pixel and the output data of the second pixel have a specified similarity or higher. In one embodiment, the similarity may increase as the difference value between the output data of the first pixel and the output data of the second pixel decreases, and may decrease as the difference value increases.

In operation 404, when the output data of the first pixel and the output data of the second pixel have the specified similarity or higher, the display driving circuit 200 may drive the first pixel and the second pixel by using the source amplifier specified in relation to the first pixel. For example, when the difference value between the output data of the first pixel and the output data of the second pixel is within the specified shared threshold value (e.g., 2 grayscale), the display driving circuit 200 may drive the first pixel and the second pixel by using the source amplifier specified in relation to the first pixel.

Figure 4B:
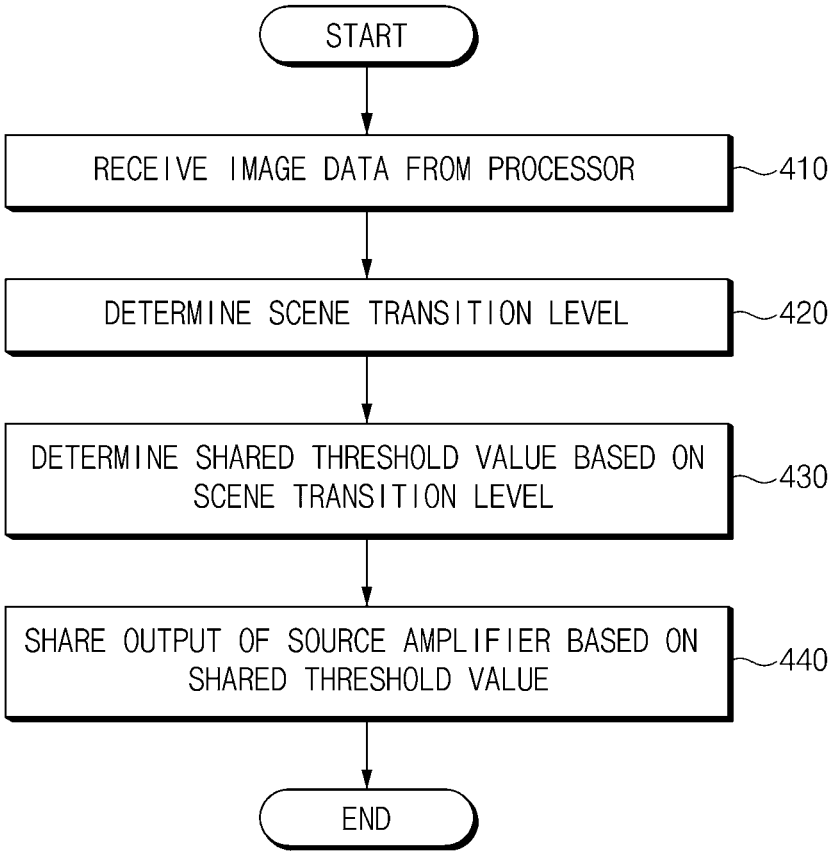
FIG. 4B is a flowchart illustrating an image output method according to various embodiments.

FIG. 4B is a flowchart illustrating an image output method according to various embodiments.

Referring to FIG. 4B, in operation 410, the display driving circuit 200 may receive the image data from the processor 140.

In operation 420, the display driving circuit 200 may determine the scene transition level of the image data. For example, the scene transition level may be a degree to which a sum of output data is changed at a specified calculation period (e.g., every 1 frame, every 3 frames, etc.). The display driving circuit 200 may determine the scene transition level by comparing the sum of the output data with one or more preset reference values.

In operation 430, the display driving circuit 200 may determine the shared threshold value to be applied to the sharing of the source amplifier, based on the determined scene transition level. When the scene transition level is relatively large (e.g., playing a video), the display driving circuit 200 may set the shared threshold value to a relatively high value (e.g., 2 to 7 grayscale). In contrast, when the scene transition level is relatively small (e.g., displaying text or a still image), the display driving circuit 200 may relatively lower the shared threshold value (e.g., 0 to 2 grayscale).

In operation 440, the display driving circuit 200 may share the output of at least one source amplifier between pixels adjacent to each other, based on the determined shared threshold value. When the output of the source amplifier of the first pixel is shared with the second pixel, the display driving circuit 200 may limit the output of the source amplifier corresponding to the second pixel, thereby reducing the power consumed by the display panel 160.

According to various embodiments, the display driving circuit 200 may set the source amplifier sharing method differently by dividing the display panel 160 into a plurality of sections. For example, the display driving circuit 200 may divide the screen into four sections by dividing the screen in a horizontal direction, and may determine the scene transition level for each section. The display driving circuit 200 may set the shared threshold value differently for each section depending on the scene transition level determined in each section. For another example, the display driving circuit 200 may divide the screen into four sections by dividing the screen in the horizontal direction, and may determine the scene transition level for some sections. The display driving circuit 200 may set the shared threshold value differently for each section depending on the scene transition level determined in the some sections.

According to various embodiments, the display driving circuit 200 may divide the display panel 160 into a plurality of sectors, and may determine the scene transition level in each sector. The display driving circuit 200 may set a first shared threshold value that is a relatively large value for a moving section in which the scene transition level is greater than or equal (or excess) to a specified reference value. The display driving circuit 200 may set a second shared threshold value that is a relatively small value for a still section in which the scene transition level is less than (or less than or equal) the specified reference value. The display driving circuit 200 may share the source amplifier between adjacent pixels depending on the shared threshold value set in each section.

Figure 5:
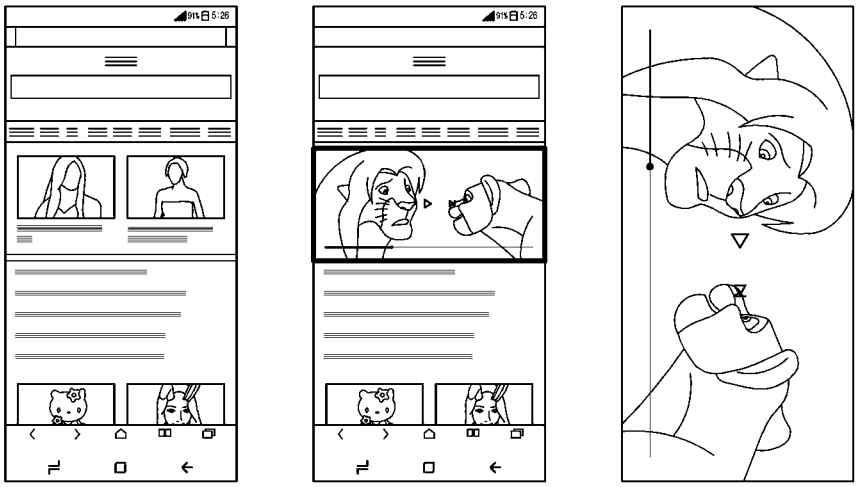
FIG. 5 illustrates a change of a shared threshold value depending on a scene transition according to various embodiments.
Figure 5:
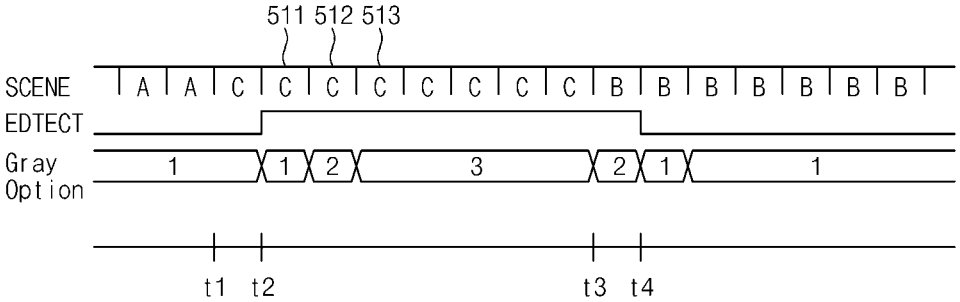

FIG. 5 illustrates a change of a shared threshold value depending on a scene transition according to various embodiments. FIG. 5 is exemplary and is not limited thereto.

Referring to FIG. 5, a first screen "A" may be a still image in which there is no a separate scene transitions. A second screen "B" may be a screen in which a video is played in part and a still image is included in another part. A third screen "C" may be a screen in which the video is played as a whole.

The display driving circuit 200 may detect the scene transition level of an image currently being output, and may determine the shared threshold value to be applied to image data to be subsequently output.

For example, in a state in which the first screen "A" is being output to the display panel 160, the display driving circuit 200 may analyze image data corresponding to the first screen "A". The display driving circuit 200 may compare image data at a specified frame interval. When it is determined as a still image without separate moving, the display driving circuit 200 may set a relatively low level shared threshold value (e.g., 0 to 1 grayscale). When the output data between adjacent pixels is within the shared threshold value (e.g., 0 to 1 grayscale), the source amplifier may be shared. When the output data between adjacent pixels exceeds the shared threshold value, each pixel may be driven by separate source amplifiers.

At a time t1, when the image data change from the first screen "A" to the third screen "C", at a time t2, the display driving circuit 200 may detect the scene transition.

The display driving circuit 200 in response to the detection of the scene transition, may set a relatively high level of shared threshold value (e.g., 2 to 7 grayscale) to correspond to the third screen "C" that is the video screen as a whole.

In one embodiment, when the scene is transitioned, the display driving circuit 200 may sequentially increase the shared threshold value. For example, after the screen transition is detected, the display driving circuit 200 may maintain the shared threshold value for a first frame 511 as 1 grayscale. The display driving circuit 200 may change the shared threshold value for a second frame 512 that is a subsequent frame to 2 grayscale. The display driving circuit 200 may change the shared threshold value for the third frame 513 that is a subsequent frame to 3 grayscale.

According to an embodiment, while the third screen "C" is maintained, the display driving circuit 200 may dynamically change the shared threshold value in a specified range (e.g., 2 to 7 grayscale) depending on the scene transition level of displayed content.

At a time t3, when the image data change from the third screen "C" to the second screen "B", at a time t4, the display driving circuit 200 may detect the scene transition.

The display driving circuit 200 may set an intermediate level shared threshold value to correspond to the second screen "B" that is the video screen as a whole in response to detection of the scene transition.

Figure 6:
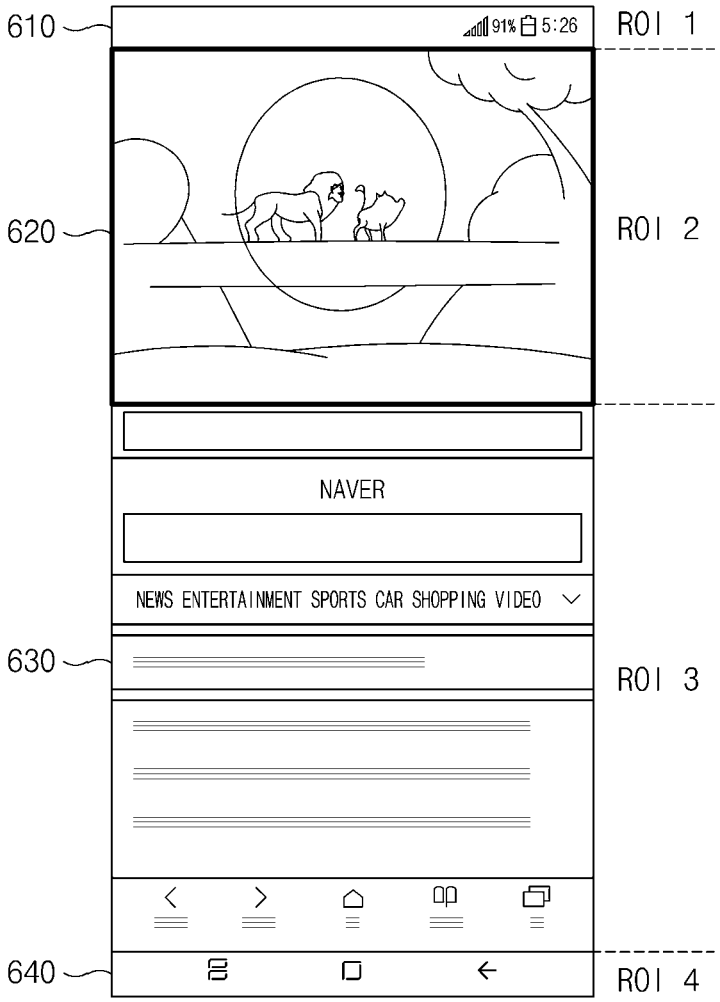
FIG. 6 is an exemplary view of a screen sharing a source amplifier by dividing a display panel into a plurality of sections, according to various embodiments.

FIG. 6 is an exemplary view of a screen sharing a source amplifier by dividing a display panel into a plurality of sections, according to various embodiments. FIG. 6 is exemplary and is not limited thereto.

Referring to FIG. 6, the display driving circuit 200 may divide the display panel 160 into a plurality of sections and may set a shared threshold value for each section. The display driving circuit 200 may share the source amplifier between adjacent pixels, based on the shared threshold value set in each section.

According to an embodiment, the display driving circuit 200 may receive a control signal from the processor 140 and may divide the display panel 160 into the plurality of sections, based on the received control signal. The display driving circuit 200 may receive coordinate information for distinguishing sections of the display panel 160 from the processor 140, independent of the image data for output.

For example, the display driving circuit 200 may receive CASET and PASET (2 Ah and 2 Bh) settings that set the section in which the screen is updated from the processor 140. Alternatively, the display driving circuit 200 may receive coordinate information for setting the section for each application from the processor 140.

According to various embodiments, the processor 140 may provide coordinate information associated with an indication bar section 610, a moving section 620 where a video is played, a still section 630 where a still image is played, and a navigation bar section 640 to the display driving circuit 200 depending on the type of the application being executed. The display driving circuit 200 may divide the display panel 160, based on the received coordinate information. The display driving circuit 200 may set a fixed shared threshold value for some sections without calculating the scene transition level. For example, the indication bar 610 and the navigation bar 620 may apply sharing of the source amplifier, based on the fixed shared threshold value, respectively.

According to various embodiments, the display driving circuit 200 may receive user interface information associated with an application executed in the moving section 620 and the still section 630. For example, the display driving circuit 200 may store information regarding a changeable user interface in advance, and may set the shared threshold value of each section, based on the stored information.

According to various embodiments, the display driving circuit 200 may receive information associated with a type (or category) of an application being executed from the processor 140. The display driving circuit 200 may store information regarding the changeable user interface in the received category in advance, and may set the shared threshold value for each section, based on the stored information. For example, when the application being executed is an e-book app, the display driving circuit 200 may apply the fixed shared threshold value without calculating the scene transition level. For another example, when the application being executed is a game app, the display driving circuit 200 may set the shared threshold value by calculating the scene transition level in an entire section.

According to various embodiments, the display driving circuit 200 may partially change the shared threshold value, based on illuminance information or brightness information. For example, when ambient illuminance detected by the sensor is greater than or equal to a specified value, the display driving circuit 200 may set a shared setting value relatively high. For another example, when brightness set in the electronic device 101 exceeds the specified value, the shared setting value may be set relatively low.

According to various embodiments, the display driving circuit 200 may set the shared threshold value depending on a driving mode (e.g., normal mode/power saving mode/ultra-power saving mode) of the electronic device 101. For example, when the electronic device 101 is in the ultra-power saving mode, the display driving circuit 200 may set the shared threshold value relatively high.

Figure 7:
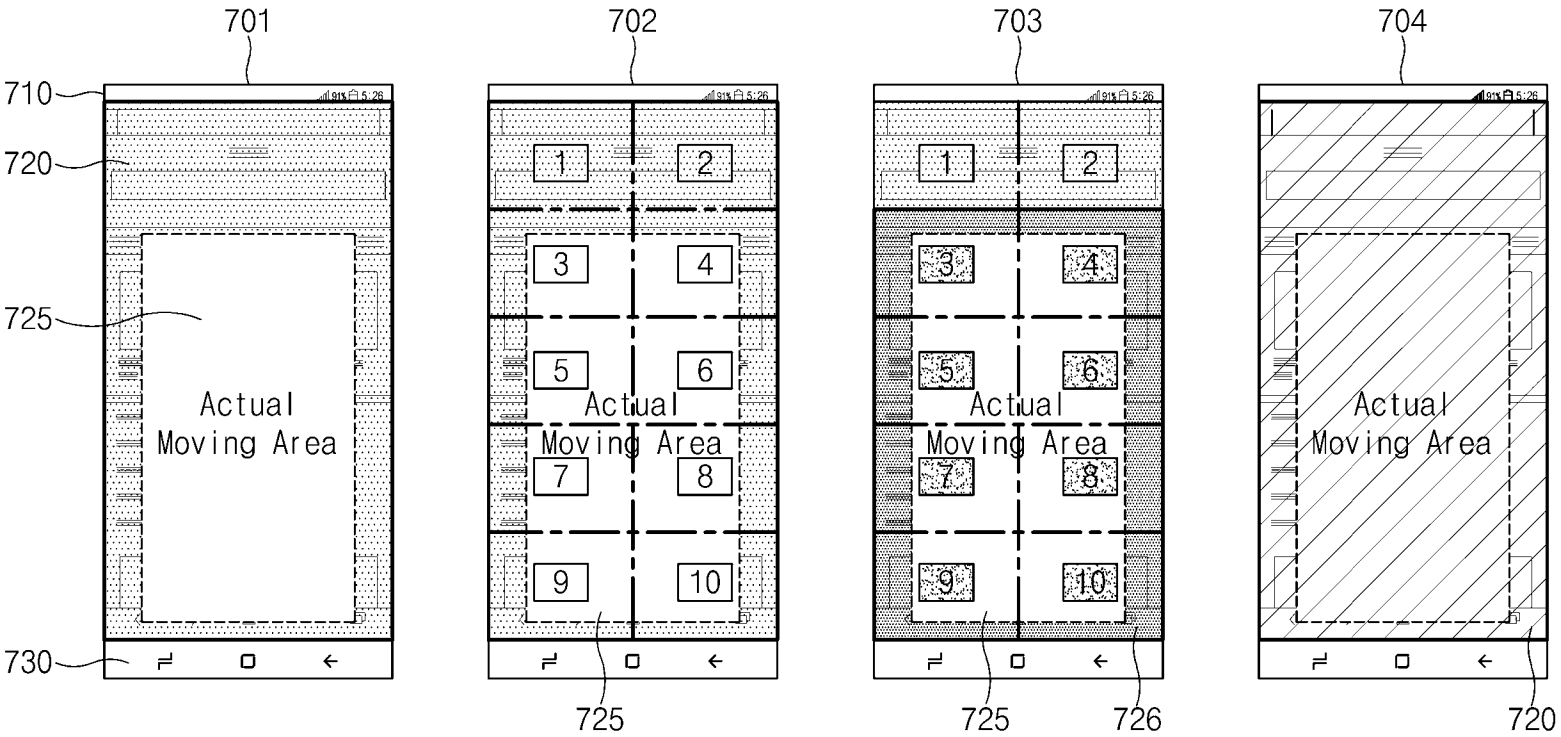
FIG. 7 is an exemplary view of a screen detecting a moving section according to various embodiments.

FIG. 7 is an exemplary view of a screen detecting a moving section according to various embodiments.

Referring to FIG. 7, the display driving circuit 200 may divide at least a part (hereinafter, an analysis section) of the display section into a plurality of sections, and may set the shared threshold value for each section.

According to an embodiment, the display driving circuit 200 may set the entire section of the display panel 160 as the analysis section. The display driving circuit 200 may divide the entire section of the display panel 160 into a plurality of sections, and may calculate the scene transition level in each section.

For another example, remaining sections except for the indication bar section at the top of the display panel 160 and the navigation bar section at the bottom of the display panel 160 may be set as the analysis section. Hereinafter, the analysis section will be mainly discussed in the case where it is set except for the indicator bar section and the navigation bar section, but is not limited thereto.

On a screen 701, the display driving circuit 200 may display the image data in which the still image is displayed as the background and a video is being executed in some sections. The display driving circuit 200 may set the remaining sections except for an indicator bar section 710 and a navigation bar 730 as an analysis section 720. The analysis section 720 may include an actual moving section (e.g., a video playback section) 725 at least partially.

Figure 8:
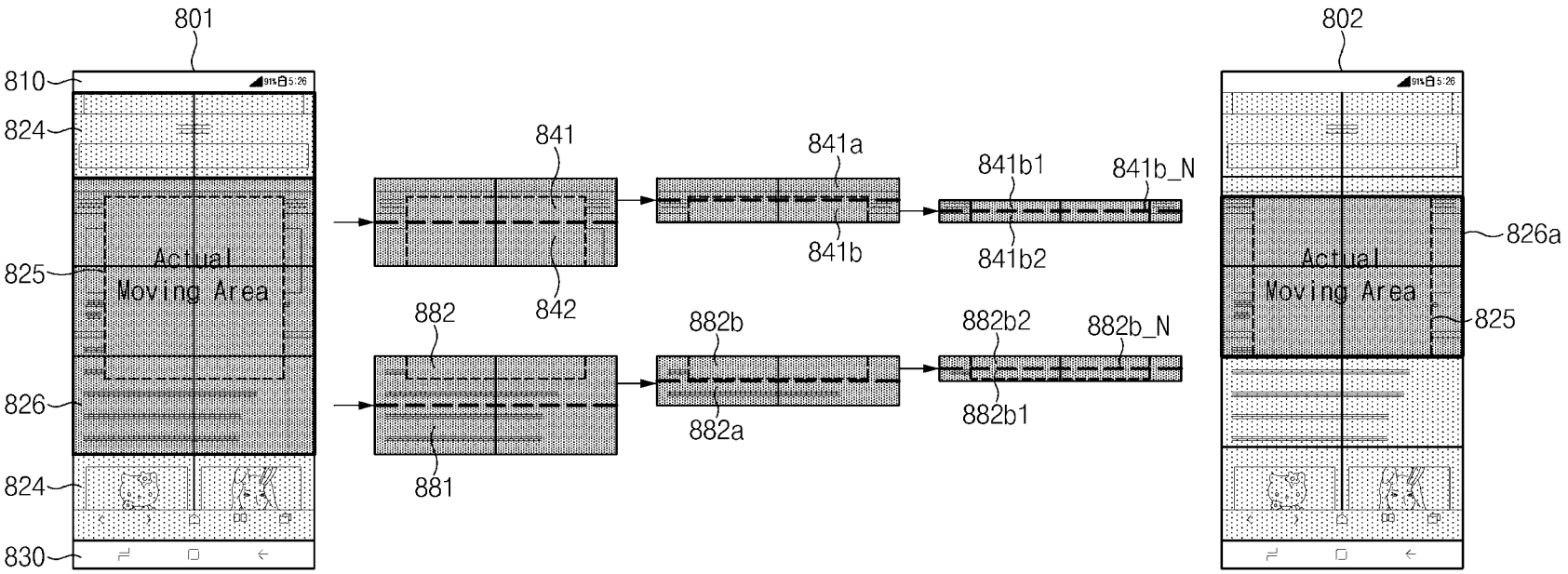
FIG. 8 is an exemplary view of a screen determining a moving section in a dynamic manner according to various embodiments.

On a screen 702, the display driving circuit 200 may divide the analysis section 720 into a specified number of sections. For example, the display driving circuit 200 may divide the analysis section 720 into two columns in a vertical direction and may divide them into five rows in the horizontal direction, and may divide them into a total of 10 sections. In FIG. 8, a case where the display driving circuit 200 divides the analysis section 720 into first to tenth sections is exemplarily illustrated, but is not limited thereto. For example, the display driving circuit 200 may divide the separate section 720 into 2, 4, 6, 8, or the like.

According to various embodiments, the display driving circuit 200 may dynamically divide the analysis section 720, based on information (e.g., application information being driven, information on displayed content, information on brightness setting of the display, and information about power driving mode) received from the processor 140

On a screen 703, the display driving circuit 200 may calculate the scene transition level in each section. The display driving circuit 200 may apply various types of scene transition detection algorithms. For example, the display driving circuit 200 may sum the values of the output data of the current frame for each section and may compare the summed results with a sum of the output data of the previous frame.

The display driving circuit 200 may determine a section in which a difference in output data between a current frame and a previous frame exceeds a reference value as the moving section. The display driving circuit 200 may determine a section in which the difference in output data between the current frame and the previous frame does not exceed a moving reference value as the still section. In the example of FIG. 8, the third to tenth sections may be moving sections. The first section and the second section may be the still sections. According to an embodiment, the moving section or the still section may be determined by sampling some pixels in each section.

The display driving circuit 200 may combine each moving section and set it as a moving section 726 that is detected.

According to various embodiments, the display driving circuit 200 may set the first shared threshold value with respect to the moving sections (third to tenth sections). The display driving circuit 200 may set the second shared threshold value with respect to the still sections (first section and second section). The first shared threshold value may be greater than the second shared threshold value. In one embodiment, the first shared threshold value may be a value that changes in a specified range. For example, the display driving circuit 200 may set the first shared threshold value to one of 2 to 7 grayscales. When the scene transition level of the moving section is large, the display driving circuit 200 may set the shared threshold value (e.g., 7 gray scale) that has a relatively large value. In contrast, when the scene transition level of the moving section is small, the display driving circuit 200 may set the shared threshold value (e.g., 2 gray scale) that has a relatively small value.

On a screen 704, the display driving circuit 200, when a ratio of the moving section 726 to the analysis section 720 is a preset first ratio (e.g., 80%) or more, may set the entire analysis section 720 as the moving section. The display driving circuit 200 may share the source amplifier with respect to the entire analysis section 720, based on the first shared threshold value applied to the moving section.

According to another embodiment, when the ratio of the moving section 726 to the analysis section 720 is equal to or less than a preset second rate (e.g., 20%), the display driving circuit 200 may allow the source amplifier to be shared with respect to the entire analysis section 720, based on the second shared threshold value applied to the still section. Alternatively, the display driving circuit 200 may not apply the sharing of the source amplifier with respect to the entire analysis section 720.

FIG. 8 is an exemplary view of a screen determining a moving section in a dynamic manner according to various embodiments. FIG. 8 is exemplary and is not limited thereto.

Referring to FIG. 8, on a screen 801, the display driving circuit 200 may display the image data in which the still image is displayed as the background and a video is being executed in some sections. The display driving circuit 200 may set remaining sections except for an indicator bar section 810 and a navigation bar 830 as an analysis section 820.

The display driving circuit 200 may divide the analysis section 820 into a specified number of sections. The display driving circuit 200 may calculate the scene transition level in each section. The display driving circuit 200 may determine a section in which the scene transition level exceeds the specified moving reference value as the moving section.

The display driving circuit 200 may combine each of the moving sections to set a detected moving section 826. The display driving circuit 200 may extract a detected moving section 726 greater than an actual moving section 825 through primary detection.

The sharing threshold value to which the sharing of the source amplifier is applied may be different from each other, focusing on the boundary between the moving section 826 and a still section 824. For example, back and forth of a boundary between a second section that is part of the still section 824 and a fourth section that is part of the moving section 826, the sections are all the same actual still section, but the first shared threshold value having a relatively large value may be applied to the fourth section, and the second shared threshold value having a relatively small value may be applied to the second section. Due to this, there is a possibility that the user senses a level difference in image quality at the boundary between the moving section 826 and the still section 824.

According to various embodiments, the display driving circuit 200 may reset the boundary between the moving section 826 and the still section 824 by an adaptive method to prevent a user from sensing the level difference in the image quality.

For example, the display driving circuit 200 may separate a section (third section and fourth section) contacting the still section 824 of the moving section 826 into the first section contacting the still section 824 and a second section separated from the still section 824. The display driving circuit 200 may calculate the scene transition level in a first part and a second part, respectively.

When both the first part and the second part are the moving sections, the display driving circuit 200 may repeat division and calculation of scene transition level with respect to the first part. When the first part is the still section and the second part is the moving section, the display driving circuit 200 may repeat division and calculation of scene transition level with respect to the second par. When the first part or the second part becomes less than the minimum division unit (e.g., 10 pixels), the display driving circuit 200 may determine a new boundary between the moving section and the still section, based on the boundary between the first part and the second part.

For example, at the boundary between the second section and the fourth section (or the boundary between the first section and the third section), the display driving circuit 200 may divide the third section and the fourth section into first part 841 and second part 842. When both the first part 841 and the second part 842 are the moving sections, the display driving circuit 200 may further divide the first part 841 into a first part 841*a* and a second part 842*b*.

When the first part 841*a* is the still section, and the second part 842*b* is the moving section, the second part 842*b* may be divided into a first part 841*b*1 and a second part 841*b*2.

When a width of the first part 841*b*1 and the second part 841*b*2 is less than a preset minimum pixel width (e.g., 10 pixels), and both the first part 841*b*1 and the second part 841*b*2 are the moving section, the display driving circuit 200 may set a boundary 841*b*_N between the first part 841*b*1 and the second part 841*b*2 as a new boundary between the moving section and the still section. Alternatively, the display driving circuit 200 may set a new boundary or set a boundary between the first part 841*a* and the second part 842*b* of a previous stage as a new boundary between the moving section and the still section.

For another example, the display driving circuit 200, for example, at a boundary between an eighth section and a tenth section (or a boundary between a seventh section and a ninth section), may divide the seventh section and the eighth section into a first part 881 and a second part 882. When the first part 881 is the still section and the second part 882 is the moving section, the display driving circuit 200 may further divide the second part 882 into a first part 882*a* and a second part 882*b*.

When the first part 882*a* is the still section and the second part 882*b* is the moving section, the second part 88*b* may be divided into a first part 882*b*1 and a second part 882*b*2.

When a width of the first part 882*b*1 and a width of the second part 882*b*2 is less than a preset minimum pixel width (e.g., 10 pixels), and both the first part 882*b*1 and the second part 882*b*2 are the moving section, the display driving circuit 200 may set a boundary 882*b* N between the first part 882*b*1 and the second part 882*b*2 as a new boundary between the moving section and the still section. Alternatively, the display driving circuit 200 may set a boundary between the first part 882*a* and the second part 882*b* of a previous stage as a new boundary between the moving section and the still section.

On a screen 802, a moving section 826*a* reset by the adaptive method may be changed close to the actual moving section 825.

According to various embodiments, the display driving circuit 200 may set a new boundary between the moving section and the still section in a similar manner in left and right directions. Through this, an error between the actual moving section 825 and the detected moving section 826 may be reduced.

Figure 9:
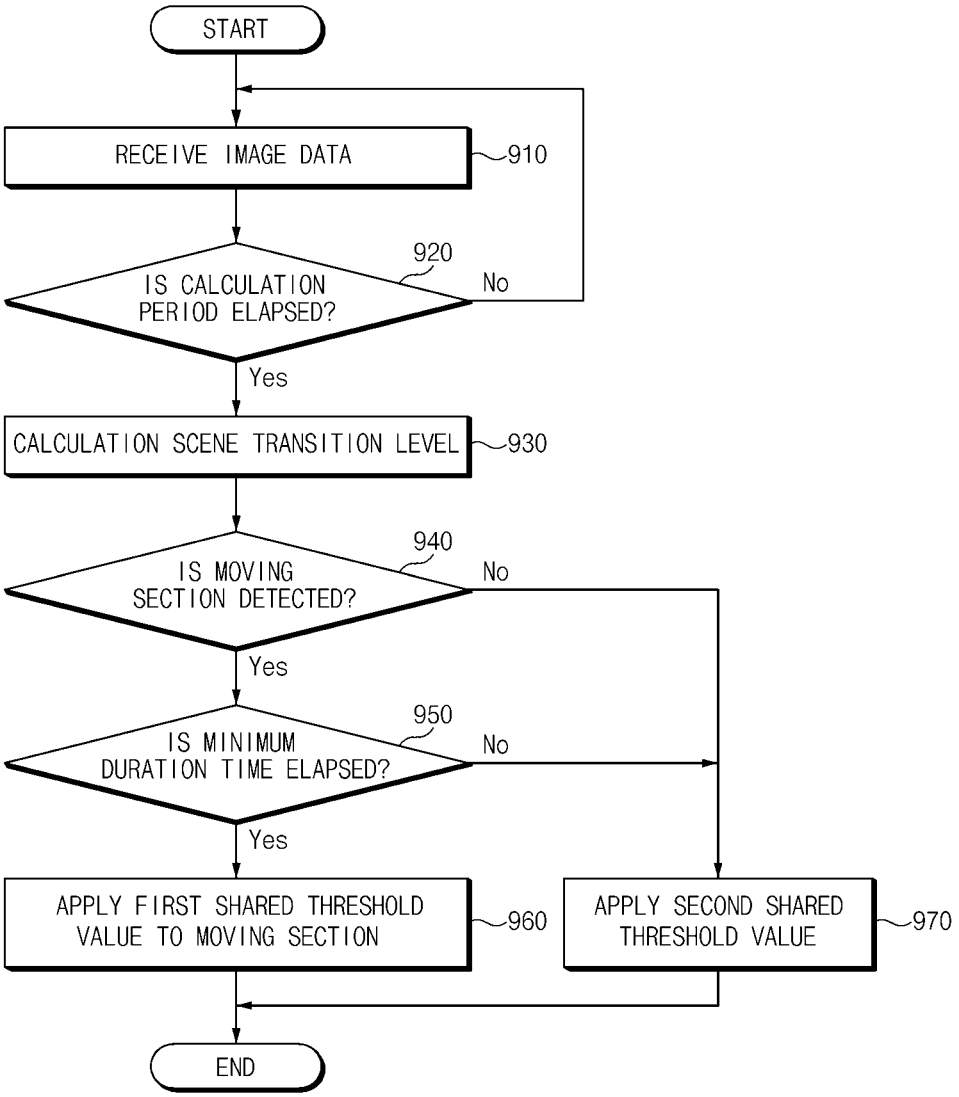
FIG. 9 is a flowchart illustrating a method of sharing a source amplifier depending on various conditions according to various embodiments.

FIG. 9 is a flowchart illustrating a method of sharing a source amplifier depending on various conditions according to various embodiments.

Referring to FIG. 9, in operation 910, the display driving circuit 200 may receive image data to be output through the display panel 160 from the processor 140.

In operation 920, the display driving circuit 200 may determine whether a period for calculating the scene transition level elapses. For example, when the period is 3 frames, the display driving circuit 200 may calculate the scene transition level every 3 frames. For another example, when the period is 1 frame, the display driving circuit 200 may calculate the scene transition level every frame.

According to one embodiment, the period may be stored in advance, reflecting a period in which content is scrolled on a screen, a period of change of a video, a resolution of the display panel 160, an operation state of an application, and the like.

According to various embodiments, the display driving circuit 200 may change the period, based on information (e.g., application information being driven, information about displayed content, information regarding brightness setting of the display, and information about power driving mode) received from the processor 140

For example, the display driving circuit 200 may set a relatively long period when the running application is the e-book app and may set a relatively short period when the running application is the game app. For another example, the display driving circuit 200 may set a relatively long period when the display is set to a low brightness, and may set a relatively short period when the display is set to a high brightness.

In operation 930, the display driving circuit 200 may calculate the scene transition level when the period elapses. According to an embodiment, the display panel may be divided into a plurality of sections, and the scene transition level may be calculated in each section. For example, the scene transition level may be a difference value of a sum of image data of a corresponding section in a previous frame and a sum of image data of a corresponding section in a current frame.

In operation 940, the display driving circuit 200 may determine whether the moving section is detected. According to an embodiment, the display driving circuit 200 may combine a plurality of moving sections to determine the moving section.

In operation 950, when the moving section is detected, the display driving circuit 200 may determine whether a minimum moving duration time elapses. For example, the minimum moving duration time may be 3 frames.

In operation 960, when the minimum moving duration time elapses, the display driving circuit 200 may share the source amplifier between adjacent pixels with the first shared threshold value thus set in advance with respect to the moving section.

According to various embodiments, the display driving circuit 200 may assign a weight to the first shared threshold value, based on the scene transition level.

In operation 970, when the moving section does not exist or the moving section disappears before the moving minimum duration elapses, the display driving circuit 200 may share the source amplifier between adjacent pixels, based on the second shared threshold value thus set in advance in the still section.

According to various embodiments, when the moving section detected in the analysis section is equal to or greater than a specified ratio, the display driving circuit 200 may apply the first shared threshold value to the entire analysis section.

According to various embodiments, an image output method performed by a display driving circuit of an electronic device includes receiving image data to be displayed through a display panel from a processor of the electronic device, identifying output data of a first pixel and output data of a second pixel to display the image data, and when the output data of the first pixel and the output data of the second pixel have more than a specified similarity, driving the first pixel and the second pixel by using a source amplifier specified in relation to the first pixel.

According to various embodiments, the driving of the first pixel and the second pixel may include turning on source amplifiers of the first pixel, and deactivating source amplifiers of the second pixel adjacent to the first pixel, based on the similarity, and connecting outputs of source amplifiers of the first pixel to the second pixel.

According to various embodiments, the operation of driving the first pixel and the second pixel may include determining a threshold value, based on a scene transition level of the image data, determining whether the output data of the first pixel and the output data of the second pixel are within the threshold value, when the output value of the first pixel and the output value of the second pixel are within the threshold value, deactivating the source amplifiers of the second pixel, and connecting outputs of the source amplifiers of the first pixel to the second pixel. The determining of the threshold value may include dividing the display panel into a plurality of sections, and calculating the scene transition level for each of the plurality of sections.

According to various embodiments, the dividing into the plurality of sections may include dividing a remaining section of the display panel except for an indication bar section and a navigation bar section into the plurality of sections.

According to various embodiments, the calculating of the scene transition level may include applying a first threshold value to a moving section in which the scene transition level is greater than or equal to a preset reference value among the plurality of sections, and applying a second threshold value less than the first threshold value to a still section in which the scene transition level is less than a preset reference value.

According to various embodiments, the sharing of the output of the source amplifier may include applying the first threshold value to a section greater than a sum of the moving sections when a ratio of the moving section among the plurality of sections is equal to or greater than a preset reference value.

Figure 10:
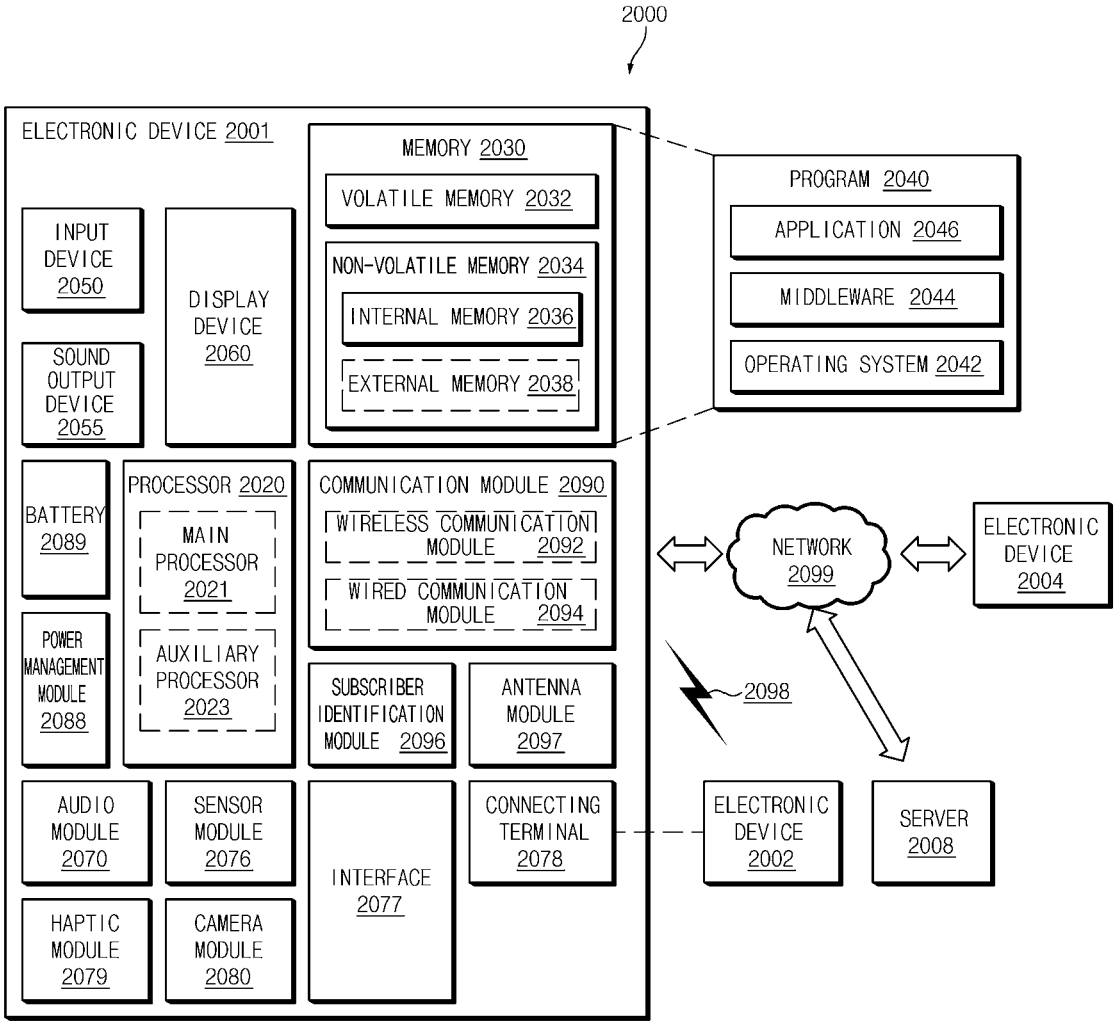
FIG. 10 is a block diagram of an electronic device in a network environment, for controlling a source driving of a pixel, based on characteristics of an image, according to various embodiments.

FIG. 10 is a block diagram of an electronic device 2001 in a network environment 2000 according to various embodiments.

Referring to FIG. 10, the electronic device 2001 (e.g., the electronic device 101 of FIG. 1) may communicate with an electronic device 2002 through a first network 2098 (e.g., a short-range wireless communication) or may communicate with an electronic device 2004 or a server 2008 through a second network 2099 (e.g., a long-distance wireless communication) in the network environment 2000. According to an embodiment, the electronic device 2001 may communicate with the electronic device 2004 through the server 2008. According to an embodiment, the electronic device 2001 may include a processor 2020, a memory 2030, an input device 2050, a sound output device 2055, a display device 2060, an audio module 2070, a sensor module 2076, an interface 2077, a haptic module 2079, a camera module 2080, a power management module 2088, a battery 2089, a communication module 2090, a subscriber identification module 2096, and an antenna module 2097. According to some embodiments, at least one (e.g., the display device 2060 or the camera module 2080) among components of the electronic device 2001 may be omitted or other components may be added to the electronic device 2001. According to some embodiments, some components may be integrated and implemented as in the case of the sensor module 2076 (e.g., a fingerprint sensor, an iris sensor, or an illuminance sensor) embedded in the display device 2060 (e.g., a display).

The processor 2020 may operate, for example, software (e.g., a program 2040) to control at least one of other components (e.g., a hardware or software component) of the electronic device 2001 connected to the processor 2020 and may process and compute a variety of data. The processor 2020 may load a command set or data, which is received from other components (e.g., the sensor module 2076 or the communication module 2090), into a volatile memory 2032, may process the loaded command or data, and may store result data into a nonvolatile memory 2034. According to an embodiment, the processor 2020 may include a main processor 2021 (e.g., a central processing unit or an application processor) and an auxiliary processor 2023 (e.g., a graphic processing device, an image signal processor, a sensor hub processor, or a communication processor), which operates independently from the main processor 2021, additionally or alternatively uses less power than the main processor 2021, or is specified to a designated function. In this case, the auxiliary processor 2023 may operate separately from the main processor 2021 or embedded.

In this case, the auxiliary processor 2023 may control, for example, at least some of functions or states associated with at least one component (e.g., the display device 2060, the sensor module 2076, or the communication module 2090) among the components of the electronic device 2001 instead of the main processor 2021 while the main processor 2021 is in an inactive (e.g., sleep) state or together with the main processor 2021 while the main processor 2021 is in an active (e.g., an application execution) state. According to an embodiment, the auxiliary processor 2023 (e.g., the image signal processor or the communication processor) may be implemented as a part of another component (e.g., the camera module 2080 or the communication module 2090) that is functionally related to the auxiliary processor 2023. The memory 2030 may store a variety of data used by at least one component (e.g., the processor 2020 or the sensor module 2076) of the electronic device 2001, for example, software (e.g., the program 2040) and input data or output data with respect to commands associated with the software. The memory 2030 may include the volatile memory 2032 or the nonvolatile memory 2034.

The program 2040 may be stored in the memory 2030 as software and may include, for example, an operating system 2042, a middleware 2044, or an application 2046.

The input device 2050 may be a device for receiving a command or data, which is used for a component (e.g., the processor 2020) of the electronic device 2001, from an outside (e.g., a user) of the electronic device 2001 and may include, for example, a microphone, a mouse, or a keyboard.

The sound output device 2055 may be a device for outputting a sound signal to the outside of the electronic device 2001 and may include, for example, a speaker used for general purposes, such as multimedia play or recordings play, and a receiver used only for receiving calls. According to an embodiment, the receiver and the speaker may be either integrally or separately implemented.

The display device 2060 (e.g., the display 110 of FIG. 1) may be a device for visually presenting information to the user and may include, for example, a display, a hologram device, or a projector and a control circuit for controlling a corresponding device. According to an embodiment, the display device 2060 may include a touch circuitry or a pressure sensor for measuring an intensity of pressure on the touch.

The audio module 2070 may convert a sound and an electrical signal in dual directions. According to an embodiment, the audio module 2070 may obtain the sound through the input device 2050 or may output the sound through an external electronic device (e.g., the electronic device 2002 (e.g., a speaker or a headphone)) wired or wirelessly connected to the sound output device 2055 or the electronic device 2001.

The sensor module 2076 may generate an electrical signal or a data value corresponding to an operating state (e.g., power or temperature) inside or an environmental state outside the electronic device 2001. The sensor module 2076 may include, for example, a gesture sensor, a gyro sensor, a barometric pressure sensor, a magnetic sensor, an acceleration sensor, a grip sensor, a proximity sensor, a color sensor, an infrared sensor, a biometric sensor, a temperature sensor, a humidity sensor, or an illuminance sensor.

The interface 2077 may support a designated protocol wired or wirelessly connected to the external electronic device (e.g., the electronic device 2002). According to an embodiment, the interface 2077 may include, for example, an HDMI (high-definition multimedia interface), a USB (universal serial bus) interface, an SD card interface, or an audio interface.

A connecting terminal 2078 may include a connector that physically connects the electronic device 2001 to the external electronic device (e.g., the electronic device 2002), for example, an HDMI connector, a USB connector, an SD card connector, or an audio connector (e.g., a headphone connector).

The haptic module 2079 may convert an electrical signal to a mechanical stimulation (e.g., vibration or movement) or an electrical stimulation perceived by the user through tactile or kinesthetic sensations. The haptic module 2079 may include, for example, a motor, a piezoelectric element, or an electric stimulator.

The camera module 2080 may shoot a still image or a video image. According to an embodiment, the camera module 2080 may include, for example, at least one lens, an image sensor, an image signal processor, or a flash.

The power management module 2088 may be a module for managing power supplied to the electronic device 2001 and may serve as at least a part of a power management integrated circuit (PMIC).

The battery 2089 may be a device for supplying power to at least one component of the electronic device 2001 and may include, for example, a non-rechargeable (primary) battery, a rechargeable (secondary) battery, or a fuel cell.

The communication module 2090 may establish a wired or wireless communication channel between the electronic device 2001 and the external electronic device (e.g., the electronic device 2002, the electronic device 2004, or the server 2008) and support communication execution through the established communication channel. The communication module 2090 may include at least one communication processor operating independently from the processor 2020 (e.g., the application processor) and supporting the wired communication or the wireless communication. According to an embodiment, the communication module 2090 may include a wireless communication module 2092 (e.g., a cellular communication module, a short-range wireless communication module, or a GNSS (global navigation satellite system) communication module) or a wired communication module 2094 (e.g., an LAN (local area network) communication module or a power line communication module) and may communicate with the external electronic device using a corresponding communication module among them through the first network 2098 (e.g., the short-range communication network such as a Bluetooth, a Wi-Fi direct, or an IrDA (infrared data association)) or the second network 2099 (e.g., the long-distance wireless communication network such as a cellular network, an internet, or a computer network (e.g., LAN or WAN)). The above-mentioned various communication modules 2090 may be implemented into one chip or into separate chips, respectively.

According to an embodiment, the wireless communication module 2092 may identify and authenticate the electronic device 2001 using user information stored in the subscriber identification module 2096 in the communication network.

The antenna module 2097 may include one or more antennas to transmit or receive the signal or power to or from an external source. According to an embodiment, the communication module 2090 (e.g., the wireless communication module 2092) may transmit or receive the signal to or from the external electronic device through the antenna suitable for the communication method.

Some components among the components may be connected to each other through a communication method (e.g., a bus, a GPIO (general purpose input/output), an SPI (serial peripheral interface), or an MIPI (mobile industry processor interface)) used between peripheral devices to exchange signals (e.g., a command or data) with each other.

According to an embodiment, the command or data may be transmitted or received between the electronic device 2001 and the external electronic device 2004 through the server 2008 connected to the second network 2099. Each of the electronic devices 2002 and 2004 may be the same or different types as or from the electronic device 2001. According to an embodiment, all or some of the operations performed by the electronic device 2001 may be performed by another electronic device or a plurality of external electronic devices. When the electronic device 2001 performs some functions or services automatically or by request, the electronic device 2001 may request the external electronic device to perform at least some of the functions related to the functions or services, in addition to or instead of performing the functions or services by itself. The external electronic device receiving the request may carry out the requested function or the additional function and transmit the result to the electronic device 2001. The electronic device 2001 may provide the requested functions or services based on the received result as is or after additionally processing the received result. To this end, for example, a cloud computing, distributed computing, or client-server computing technology may be used.

According to various embodiments, an electronic device includes a processor, a display panel that includes a plurality of pixels, the plurality of pixels including a first pixel and a second pixel, and a display driving circuit that drives the display panel and receives image data to be displayed through the display panel from the processor, and wherein the display driving circuit is composed to identify output data of the first pixel and output data of the second pixel to display the image data, and wherein, when the output data of the first pixel and the output data of the second pixel have more than a specified similarity, the display driving circuit is composed to drive the first pixel and the second pixel by using a source amplifier specified in relation to the first pixel.

According to various embodiments, the first pixel and the second pixel may be adjacent to each other, and wherein, when the output data of the first pixel and the output data of the second pixel have more than the specified similarity, the display driving circuit may turn on source amplifiers of the first pixel, may deactivate source amplifiers of the second pixel, and may connect outputs of the source amplifiers of the first pixel to the second pixel.

According to various embodiments, at least some of sub-pixels of the first pixel and at least some of sub-pixels of the second pixel, which shares the source amplifier may output light of substantially the same color.

According to various embodiments, the display driving circuit may determine a threshold value, based on a scene transition level of the image data, when the output data of the first pixel and the output data of the second pixel are within the threshold value, may deactivate source amplifiers of the second pixel and may connect outputs of the source amplifiers of the first pixel to the second pixel.

According to various embodiments, the display driving circuit may divide the display panel into a plurality of sections, and may calculate the scene transition level for each of the plurality of sections. The display driving circuit may divide a remaining section except for an indication bar section and a navigation bar section of the display panel into the plurality of sections. The display driving circuit may apply a first threshold value to a moving section of which the scene transition level is greater than or equal to a preset reference value among the plurality of sections, and may apply a second threshold value to a still section of which the scene transition level is less than the preset reference value, and the first threshold value may be greater than the second threshold value.

According to various embodiments, when a ratio of the moving section among the plurality of sections is equal to or greater than a preset reference value, the display driving circuit may apply the first threshold value to a section larger than a sum of the moving sections.

According to various embodiments, the display driving circuit may determine a section in which the scene transition level is maintained over a specified frame or more as the reference value or more among the plurality of sections as the moving section.

According to various embodiments, the display driving circuit may determine a sum section of the moving sections as the moving section, may divide sections disposed at a boundary of the moving section into a first section and a second section, and may calculate the scene transition level in each of the first section and the second section. The display driving circuit may reset the boundary, based on the scene transition level in the first section and the second section.

According to various embodiments, the display driving circuit may receive information associated with a section division of the display panel from the processor, may divide the display panel into a plurality of sections based on the information, and may connect the outputs of the source amplifiers of the first pixel to the second pixel, based on the scene transition level with regard to at least some of the plurality of sections. The display driving circuit may set a fixed threshold value for at least some of the plurality of sections regardless of the scene transition level.

According to various embodiments, each component (e.g., a module or a program) of the components may be composed of a single entity or multiple entities. Some of the aforementioned sub-components may be omitted, or other sub-components may be further included in various embodiments. Alternatively or additionally, some components (e.g., modules or programs) may be integrated into one entity to perform the same or similar functions performed by each corresponding component prior to integration. According to various embodiments, operations performed by the module, the program, or another component may be carried out sequentially, in parallel, repeatedly, or heuristically, or at least some operations may be executed in a different order or omitted, or other operations may be added.

The invention claimed is:

1. An electronic device comprising:

a processor;

a display panel configured to include a plurality of pixels including a first pixel and a second pixel; and a display driving circuit configured to drive the display panel and to receive image data to be displayed through the display panel from the processor, and wherein the display driving circuit is configured to:

divide the display panel into a plurality of sections, and calculate a scene transition level for each of the plurality of sections, determine a moving section among the plurality of sections, wherein the moving section has a plurality of frames with the scene transition level greater than or equal to a preset reference value, identify output data of the first pixel and output data of the second pixel to display the image data in the moving section, and when the output data of the first pixel and the output data of the second pixel have more than a specified similarity, drive the first pixel and the second pixel by using a source amplifier specified in relation to the first pixel.

2. The electronic device of claim 1, wherein the first pixel and the second pixel are adjacent to each other, and wherein, when the output data of the first pixel and the output data of the second pixel have more than the specified similarity, the display driving circuit turns on source amplifiers of the first pixel, deactivates source amplifiers of the second pixel, and connects outputs of the source amplifiers of the first pixel to the second pixel.

3. The electronic device of claim 2, wherein at least some of sub-pixels of the first pixel and at least some of sub-pixels of the second pixel, which share the source amplifier output light of substantially a same color.

4. The electronic device of claim 1, wherein the display driving circuit determines a threshold value, based on the scene transition level of the image data, when the output data of the first pixel and the output data of the second pixel are within the threshold value, deactivates source amplifiers of the second pixel and connects outputs of the source amplifiers of the first pixel to the second pixel.

5. The electronic device of claim 1, wherein the display driving circuit divides a remaining section except for an indication bar section and a navigation bar section of the display panel into the plurality of sections.

6. The electronic device of claim 1, wherein the display driving circuit applies a first threshold value to the moving section, and applies a second threshold value to a still section of which the scene transition level is less than the preset reference value, and wherein the first threshold value is greater than the second threshold value.

7. The electronic device of claim 6, wherein, when a ratio of the moving section among the plurality of sections is equal to or greater than a preset reference value, the display driving circuit applies the first threshold value to a section larger than a sum of a number of moving sections.

8. The electronic device of claim 6, wherein the display driving circuit determines a sum section of a number of moving sections as the moving section, divides sections disposed at a boundary of the moving section into a first section and a second section, and calculates the scene transition level in each of the first section and the second section.

9. The electronic device of claim 8, wherein the display driving circuit resets the boundary, based on the scene transition level in the first section and the second section.

10. The electronic device of claim 4, wherein the display driving circuit receives information associated with a section division of the display panel from the processor, divides the display panel into a plurality of sections based on the information, and connects the outputs of the source amplifiers of the first pixel to the second pixel, based on the scene transition level with regard to at least some of the plurality of sections.

11. The electronic device of claim 10, wherein the display driving circuit sets a fixed threshold value for at least some of the plurality of sections regardless of the scene transition level.

12. An image output method performed by a display driving circuit of an electronic device, the method comprising:

dividing a display panel into a plurality of sections, and calculating a scene transition level for each of the plurality of sections;

determining a moving section among the plurality of sections, wherein the moving section has a plurality of frames with the scene transition level greater than or equal to a preset reference value;

receiving image data to be displayed through a display panel from a processor of the electronic device;

identifying output data of a first pixel and output data of a second pixel to display the image data in the moving section; and when the output data of the first pixel and the output data of the second pixel have more than a specified similarity, driving the first pixel and the second pixel by using a source amplifier specified in relation to the first pixel.

13. The image output method of claim 12, wherein the driving of the first pixel and the second pixel includes:

turning on source amplifiers of the first pixel; and deactivating source amplifiers of the second pixel adjacent to the first pixel, based on the specified similarity, and connecting outputs of source amplifiers of the first pixel to the second pixel.

* * * * *